United States Patent [19]

Schwartz et al.

[11] 4,399,591

[45] Aug. 23, 1983

[54] EXTRACTOR-FEEDER

[75] Inventors: Robert C. Schwartz; John E. Sparks, both of Lubbock, Tex.

[73] Assignee: Horn & Gladden Lint Cleaner Company, Inc., Lubbock, Tex.

[21] Appl. No.: 357,980

[22] Filed: Mar. 15, 1982

[51] Int. Cl.[3] ..... D01G 1/00

[52] U.S. Cl. ..... 19/202; 19/55 R; 19/203

[58] Field of Search ..... 19/55 R, 200, 202, 203, 19/204, 205

[56] References Cited

U.S. PATENT DOCUMENTS

| | | | |
|---|---|---|---|
| 1,123,344 | 1/1915 | Meurling | 19/202 |
| 1,485,401 | 3/1924 | McDonough et al. | 19/202 |
| 1,585,131 | 5/1926 | Streun | 19/202 |
| 2,836,856 | 6/1958 | Franks | 19/203 |
| 3,086,254 | 4/1963 | Mitchell et al. | 19/203 |
| 3,186,036 | 6/1965 | Word | 19/203 |
| 3,467,991 | 9/1969 | Gray | 19/203 |
| 4,214,348 | 7/1980 | Schwartz | 19/203 |

*Primary Examiner*—Louis Rimrodt

*Attorney, Agent, or Firm*—Wendell Coffee

[57] ABSTRACT

Cotton in an extractor-feeder is passed through three scrubber cylinders. The first two having grid bars of a regular ¼ or 5/16 inch spacing and the third having grid bars at about twice the regular, or ½ inch spacings. Any locks of seed cotton in the trash from the third scrub cylinder are reclaimed by reclamation saw which also reclaims any cotton slung off by a main saw cylinder. Also dust is removed by a suction connected into the housing.

10 Claims, 2 Drawing Figures

EXTRACTOR-FEEDER

BACKGROUND OF THE INVENTION (1) Field of the Invention

This invention relates to ginning cotton and more particularly to an extractor-feeder.

(2) Description of the Prior Art

Extractor-feeders are a common piece of equipment found in most cotton gins. The cotton is cleaned by extracting trash from the seed cotton by two processes within the extractor-feeder.

One of the processes is that of scrubbing. In scrubbing, the seed cotton is scrubbed over concave surfaces permitting the trash to sift out. In the prior art it was recognized that the size of the opening limits the kind and size of trash that can be scrubbed through. The regular spacing between bars is ¼ or 5/16 inch. It is recognized that only smaller particles of broken leaves, dirt and small sticks and stem can be removed with a minimum loss of cotton.

The other basic type cleaning process is extraction wherein tooth saws on a cylinder seize or snag the cotton locks and slings the trash off by centrifugal force or removes it by striking it against grid bars. (Cleaning and Extracting by W. E. Garner and R. V. Baker, page 18, Cotton Ginners Handbook, Agricultural Handbook #503, Agricultural Research Service, United States Department of Agriculture, distributed by the Superintendent of Documents, issued July 1977.)

The purpose of the extractor-feeder is a two-fold purpose: The primary purpose is to feed the seed cotton to the gin stand uniformly and at controllable rates. Extracting and cleaning of the seed cotton is a secondary function.

SUMMARY OF THE INVENTION (1) New and Different Function

We have found that the cleaning of the cotton can be more efficiently done without detrimental effect on the uniformity of the feeding. This is accomplished by providing at least two stages of the scrubbing-type cleaning, and increasing the spacing between the grid bars on the last scrubbing stage so that some cotton passes through the grid bars. The material which passes through the grid bars is fed to the reclamation saw to reclaim this cotton. A main saw cylinder extracts other trash from the seed cotton and this reclamation saw is present for reclaiming cotton which are thrown off by this main saw cylinder.

Therefore, our invention operates in a manner not commercially feasable by present scrubbing-type cleaner, i.e. with wide spacing between the bars, so that more and larger trash can be removed by this type cleaning and still be able to reclaim cotton without any additional machinery. This is because the reclamation saw is present in connection with the main saw cylinder.

Furthermore, we have found removing a certain amount of air from the extractor cleaner results in cleaner cotton, less dust in the gin plant, and does not remove any appreciable amount of cotton lint.

Therefore, it may be seen that the total function of our invention far exceeds the sum of the functions of the individual elements because of their combination. I.e. the total function of the machine is greater than the combined functions of the individual scrubbers, grid bars, saw cylinders, doffers, etc.

(2) Objects of this Invention

An object of this invention is to feed cotton to a gin stand and clean it in the process.

Further objects are to achieve the above with a device that is sturdy, compact, durable, simple, safe, efficient, versatile, ecologically compatible, energy conserving, and reliable yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses and advantages thereof, will clearly appear from the following description and from the accompanying drawing, which is not a scale drawing.

DESCRIPTION OF THE PREFERRED EMBODIMENT

Figure 1:
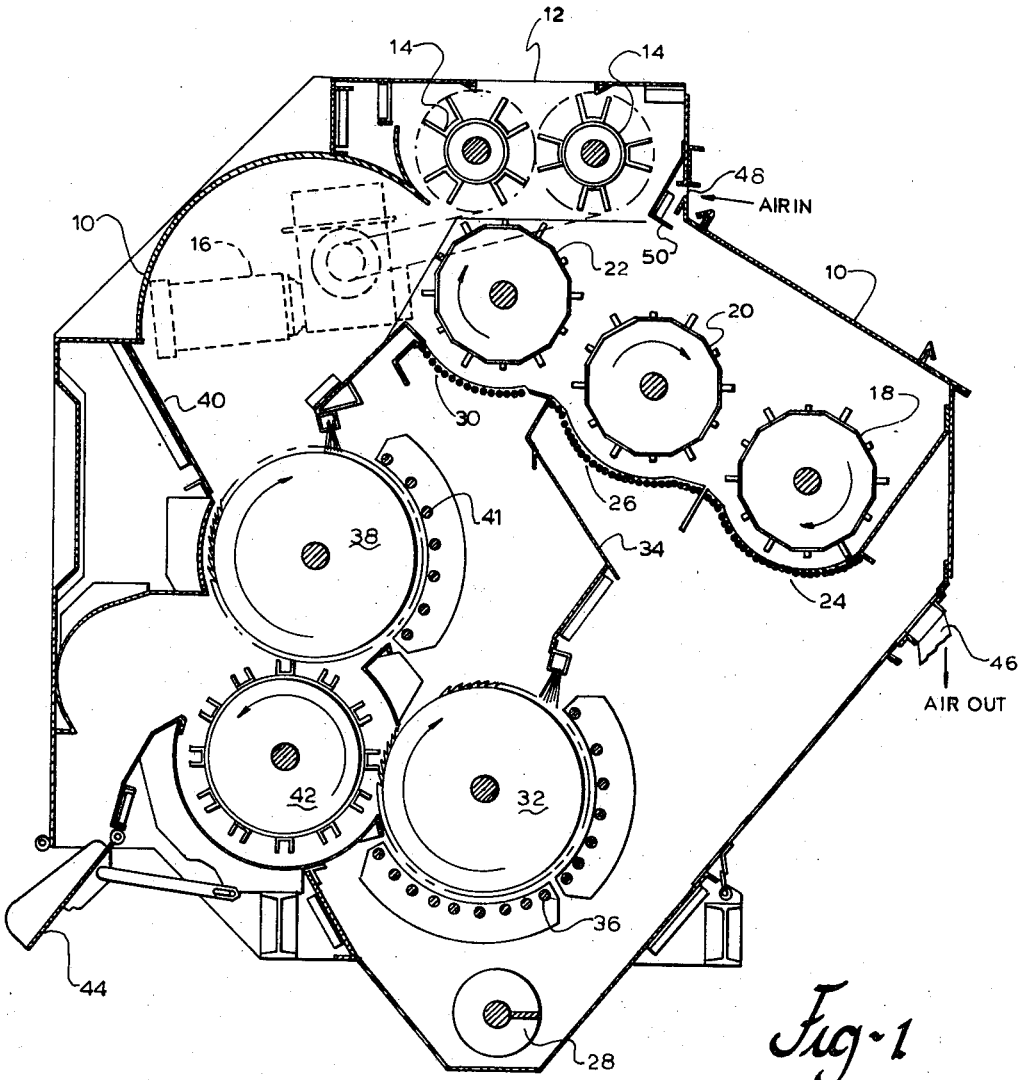
FIG. 1 is a cross sectional representation of a an extractor-feeder according to this invention.
Figure 2:
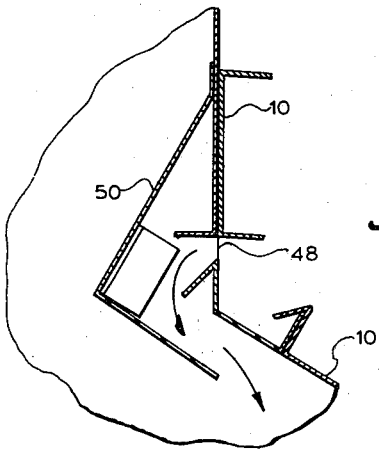
FIG. 2 is a detail of the air inlet means.

Referring to the drawing, there may be seen a representation of an extractor-feeder according to this invention. The feeder includes a general housing 10 enclosing the parts. The housing will have various access doors and inspection windows as is customary in machinery of this sort. Neither the access doors nor the inspection windows have been shown on the drawing for clarity of the drawing.

Cotton is fed from the distributor through feeding opening 12 onto two feed rollers 14. The feed rollers 14 are driven by a variable speed motor 16 mounted on the exterior of the housing. The feed rate of the cotton to the gin stand is determined by the speed of the variable speed motor 16 as is customary.

The cotton is dropped above the scrub cylinders 18, 20, and 22. The scrub cylinders are rotated in a direction as shown by arrows thereon by means not shown in the drawing inasmuch as it is purely conventional. Also the other equipment, such as the trash conveyor or auger 28, reclamation saw cylinder 32, main saw cylinder 38 and doffing cylinder 42, are rotated by conventional means not shown. It will be understood by those skilled in the art that all the shafts of the cylinders, rollers, and conveyors are supported by bearings upon their ends at the housing as is conventional.

Scrub cylinder 18 is located above grid bars 24. The grid bars 24 have regular spacing. I.e. the grid bars include ⅜ inch bars on ⅝ or 11/16 inch centers, so there is ¼ or 5/16 inch clearance between the bars. Seed cotton is moved to the scrub cylinder 20 wherein it is scrubbed. over grid bars 26, also having the same regular spacing as grid bars 24. The trash falling from scrub cylinders 18 and 20 (which is the trash falling through the grid bars 24 and 26) drops downward by gravity and is directed by the housing 10 to trash auger or conveyor 28.

The seed cotton from scrub cylinder 20 is moved to scrub cylinder 22. Grid bars 30 beneath scrub cylinder 22 are widespread. I.e. they are constructed of ⅜ inch rods on ⅞ inch centers so that there is ½ inch clearance between the bars. Therefore, it may be seen that the grid bars 30 have a wider spacing than the closely-spaced grid bars at 24 and 26. As discussed above, the trash passing through the wide-spread grid bars 30 will contain some locks of seed cotton therewith. Therefore, the trash dropping from the wide-spaced grid bars 30 are dropped upon reclamation saw cylinder 32. The trash from grid bars 26 are prevented from falling upon reclamation saw cylinder 32 by internal baffles 34. Any locks of cotton contained in the trash from the wide-spread grid bars 30 are seized or snagged by the saw cylinder 32 and the remainder of the trash is expelled through the reclamation saw grid bars 36.

The seed cotton from scrub cylinder 22 is moved from that area to above main saw cylinder 38. It is directed on to the main saw cylinder by baffle 40. There the seed cotton from the final scrub cylinder 22 is seized or snagged with the teeth upon the saw cylinder 38 while the trash is extracted through main saw cylinder grid bars 41. The trash extracted through main saw grid bars 41 will have some cotton therein, and therefore this trash with the cotton is also directed to reclamation saw cylinder 32 which reclaims any cotton therein, same as cotton from the wide-spread grid bars 30 is reclaimed. The trash extracted from the reclamation saw 32 passes through the grid bars 36 and falls into the trash auger or conveyor 28 for conventional removal. The locks of seed cotton upon the reclamation saw 32 and main saw cylinder 38 are doffed by doffing cylinder 42 and are directed from the doffing cylinder by conventional baffles to feeding apron 44.

The operation of the extractor cleaner as a unit, and also as an integral part of the gin plant, is improved if a suction is connected to the extractor feeder. The suction is connected by suction outlet 46 to the housing 10, adjacent to or below the scrub cylinder 18. The principal inlet air enters the housing through an inlet air opening 48, which is located adjacent to the feed rollers 14 through the housing 10. Air baffle 50 directs the air downward and along the housing so that the major part of the air flow is from the inlet 48 against the air baffle 50 along the portion of the housing 10 across the scrub cylinders and through the scrub grid bars 24 and 26 and on to the suction outlet 46 as illustrated in the drawing. Those having skill in the art will recognize that not all of the air will enter through the opening or vent 48. A certain amount of air will enter with the entering cotton through feeding opening 12. A certain amount will enter through the outlet at the apron 44. Also, a certain amount will "leak" into the housing 10 around unsealed openings, for example, around the shafts. It has been determined that the equipment operates well with about 900 cubic feet per minute (CFM) being taken from the suction outlet 46. The majority of the air will enter through the inlet air opening 48 and be pulled across the grid bars 24 and 26, which seems to improve the removal of small trash. Having some air enter at the other openings such as above the feeding apron 44, merely acts to reduce the general amount of dust within a gin plant itself.

The embodiment shown and described above is only exemplary. We do not claim to have invented all the parts, elements or steps described. Various modifications can be made in the construction, material, arrangement, and operation, and still be within the scope of our invention.

The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

10: general housing
12: feeding opening
14: feed rollers
16: motor
18: scrub cylinder
20: scrub cylinder
22: scrub cylinder
24: grid bars
26: grid bars
28: trash auger/conveyor
30: grid bars
32: reclamation saw cylinder
34: internal baffles
36: reclamation saw grid bars
38: main saw cylinder
40: baffle
42: doffing cylinder
44: feeding apron
46: suction outlet
48: inlet air
50: air baffle.

We claim as our invention:

1. The method of operation of an extractor-feeder for extracting trash from seed cotton and feeding the seed cotton from a distributor to a gin stand, comprising:

(a) scrubbing the cotton across closely-spaced grid rods,
(b) expelling the trash falling through the closely-spaced grid rods to a trash conveyor,
(c) also scrubbing the cotton across wide-spaced grid rods having wider spacing than the closely-spaced grid rods,
(d) expelling the material passing through the wide-spaced grid rods to a reclamation saw,
(e) thereafter snagging the seed cotton upon a main saw cylinder and
(f) stripping and cleaning, thereby extracting trash from the cotton,
(g) directing said extract from the main saw cylinder to the same reclamation saw as the material from the wide-spaced scrubbing step,
(h) doffing the cleansed seed cotton from the reclamation saw and from the main saw cylinder, and
(i) directing said doffed cotton to a feeding tray.

2. The invention as defined in claim 1 including limitations (a) through (i) further comprising:

(j) said spacing between said closely-spaced grid bars being 5/16 inch between grid bars, and
(k) said spacing between said wide-spaced grid bars being ½ inch between grid bars.

3. The invention as defined in claim 1 including limitations (a) through (i) further comprising:

(j) scrubbing the cotton across the closely-spaced grid bar before scrubbing the cotton across wide-spaced grid bars.

4. The invention ad defined in claim 1 including limitations (a) through (i) further comprising:

(j) sucking air from a housing surrounding the grid bars and other elements of the extractor-feeder,
(k) said air suction being beneath the grid bars.

5. An extractor-feeder having (a) two feed rollers,
(b) at least two scrub cylinders, (c) said scrub cylinders located beneath said feed rollers, (d) grid bars beneath said scrub cylinders whereby seed cotton fed by the feed rollers is scrubbed across the grid bars by the scrub cylinders in succession, (e) a main saw cylinder, (f) a reclaiming saw cylinder, (g) means for directing the cotton from the final scrub cylinder onto the main saw cylinder, (h) saw bar means for extracting trash from said main saw cylinder, (i) means for directing the extracted trash from the saw cylinder onto the reclamation saw, and (j) means for doffing seed cotton from the reclamation saw and main saw cylinder;

wherein the improvement comprises:

(k) one scrub cylinder having the grid bars closely-spaced apart, (l) another scrub cylinder having wide-spaced grid bars spaced apart by a wider spacing than the closely-spaced bars, and (m) means to direct the trash passing through said wide-spaced grid bars onto the reclamation saw.

6. The invention as defined in claim 5 including limitations (a) through (m) further comprising:

(n) said spacing between said closely-spaced grid rods being 5/16 inch between grid bars and (o) said spacing between said wide-spaced grid bars being ½ inch between grid bars.

7. The invention as defined in claim 5 including limitations (a) through (m) further comprising:

(n) means for feeding the cotton from the feed rollers to a scrubbing cylinder with closely-spaced grid bars, and (o) means for feeding cotton from the scrubbing cylinders having closely-spaced grid bars to scrub cylinder having wide-spaced grid bars.

8. The invention as defined in claim 5 including limitations (a) through (m) further comprising:

(n) said scrub cylinder having wide-spaced grid bars being said final scrub cylinder.

9. The invention as defined in claim 5 including limitations (a) through (m) further comprising:

(n) a housing around the elements of the extractor feeder, (o) a suction opening in the housing below the closely spaced grid bars, and (p) suction means for sucking air from the suction opening.

10. The invention as defined in claim 5 including limitations (a) through (m) further comprising:

(n) a housing around the elements of the extractor feeder, (o) said spacing between said closely-spaced grid rods being 5/16 inch between grid bars, (p) said spacing between said wide-spaced grid bars being ½ inch between grid bars, (q) means for feeding the cotton from the feed rollers to a scrubbing cylinder with closely-spaced grid bars, (r) means for feeding cotton from the scrubbing cylinders having closely-spaced grid bars to scrub cylinder having wide-spaced grid bars, (s) said scrub cylinder having wide-spaced grid bars being said final scrub cylinder, (t) a suction opening in the housing below the closely-spaced grid bars, (u) suction means for sucking air from the suction opening, and (v) an air inlet in the housing near the feed rollers.

* * * * *